United States Patent [19]

Moore et al.

[11] 4,333,376

[45] Jun. 8, 1982

[54] APPARATUS FOR REINFORCING NOTES SELECTED BY MORE THAN ONE KEY

[75] Inventors: Douglas R. Moore, Vernon Hills; Richard S. Swain, Des Plaines, both of Ill.

[73] Assignee: Norlin Industries, Inc., White Plaines, N.Y.

[21] Appl. No.: 150,330

[22] Filed: May 16, 1980

Related U.S. Application Data

[63] Continuation of Ser. No. 824,906, Aug. 15, 1977, abandoned.

[51] Int. Cl.³ ..... G10H 1/02

[52] U.S. Cl. ..... 84/1.27; 84/1.09; 84/1.17; 84/DIG. 22; 84/DIG. 23

[58] Field of Search ..... 84/1.27, 1.09, 1.17, 84/DIG. 22, DIG. 23

[56] References Cited

U.S. PATENT DOCUMENTS

| | | | |
|---|---|---|---|
| 2,583,566 | 1/1952 | Hanert | 84/1.17 |
| 2,846,913 | 8/1958 | Hammond | 84/1.01 |
| 3,440,324 | 4/1969 | Schrecongost et al. | 84/1.27 |
| 3,746,773 | 7/1973 | Uetrecht | 84/1.01 |
| 4,148,241 | 4/1979 | Morez et al. | 84/DIG. 22 |

*Primary Examiner*—J. V. Truhe
*Assistant Examiner*—Forester W. Isen
*Attorney, Agent, or Firm*—Allegretti, Newitt, Witcoff & McAndrews

[57] ABSTRACT

An improved system for increasing the loudness of any single note selected by playing more than a single key. A command circuit responsive to manual control, including stop tabs, enables a tone signal to be produced in response to the playing of one key or in response to the simultaneous playing of a plurality of keys on a keyboard. Means are provided for changing the relative amplitude of a tone signal produced in response to the simultaneous playing of a plurality of keys with respect to the amplitude of a tone signal produced in response to the playing of a single key.

15 Claims, 7 Drawing Figures

UNIFIED SYSTEM

STRAIGHT SYSTEM

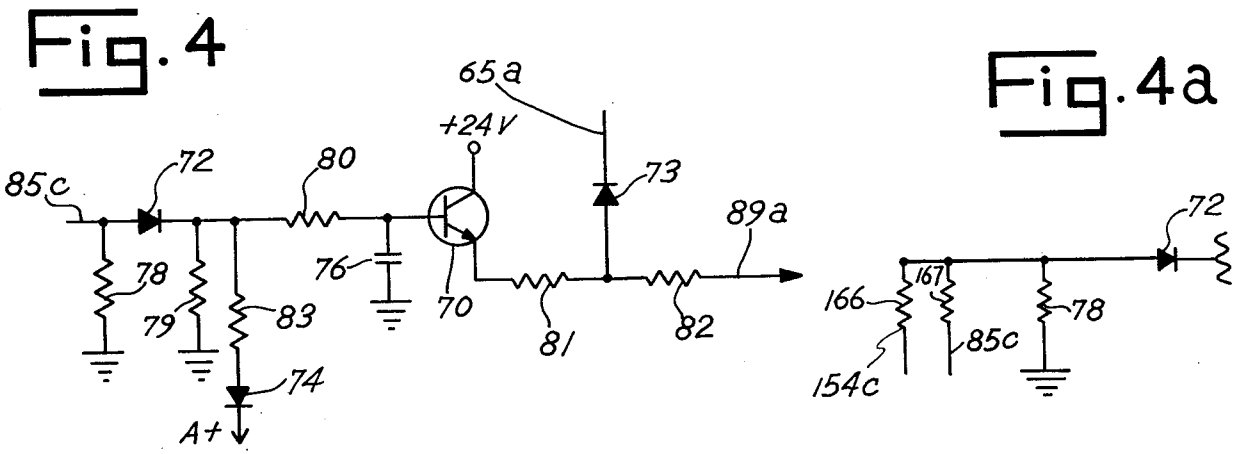
Fig. 4a
Fig. 4
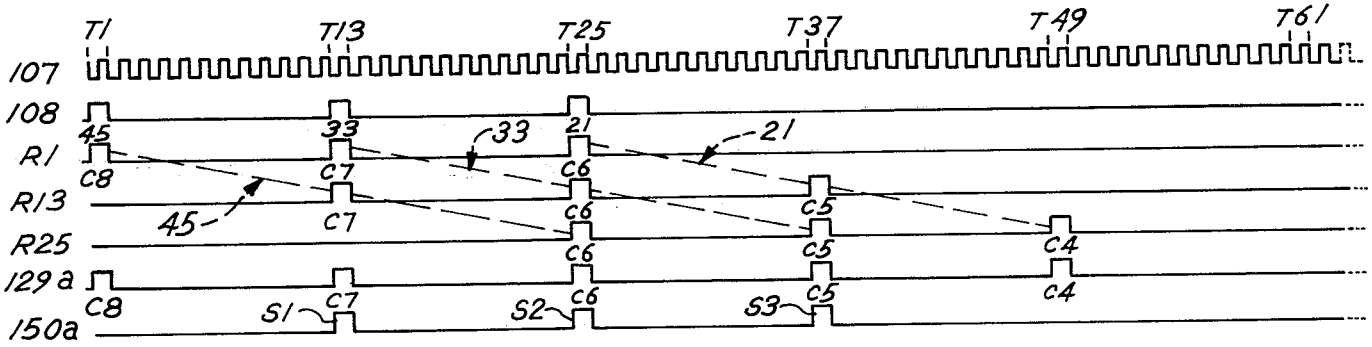
Fig. 6

APPARATUS FOR REINFORCING NOTES SELECTED BY MORE THAN ONE KEY

This is a continuation of application Ser. No. 824,906, filed Aug. 15, 1977, now abandoned.

BACKGROUND OF THE INVENTION

1. Field of the Invention

This invention relates to electronic musical instruments and more particularly relates to such instruments which are capable of playing multiple notes in response to the depression of a single key on a keyboard.

2. Description of the Prior Art

Certain keyboard instruments, such as a piano, have each of their keys assigned to a particular note or a pitch. For example, when the middle C key is depressed on a piano, only the middle C pitch is sounded by the piano strings. However, other keyboard instruments, such as pipe organs, traditionally have been able to play multiple pitches in response to the depression of a single key. This ability to vary the pitch represented by a keyboard key is implemented in pipe organs by providing a number of different ranks of pipes.

Normally, the pitch associated with a rank of pipes is given in terms of the number of feet of length of the average pipe in the rank. For example, an 8-foot rank of pipes may be pitched so that the playing of the middle C key on the keyboard (KC4) results in a pitch of about 256 Hz. In response to depression of key KC4, a 4-foot rank of pipes would produce a pitch one octave above middle C or 512 Hz. In response to depression of key KC4, a 2-foot rank of pipes would produce a note two octaves above middle C or 1024 Hz.

By properly coupling the ranks of pipes to the keyboard, notes having the pitches 256 Hz. (C4), 512 Hz. (C5) and 1024 Hz. (C6) can be simultaneously sounded by depressing a single key (e.g., middle C or KC4). Operating switches, normally referred to as stop tabs, are provided above the keyboard in order to couple the various ranks of pipes to the keys in the manner selected by the performer.

Two coupling methods generally evolved in the history of the pipe organ. According to the "straight" system of coupling, different ranks of pipes with different footages are provided in connection with each key of the keyboard. According to this "straight" system of coupling, the depression of the middle C key (KC4) could result in the pitches C4-C6 sounding in the manner previously described (e.g., by coupling 8-foot, 4-foot and 2-foot ranks of pipes to key KC4). Since separate ranks of pipes are associated with each key, the depression of the key one octave above middle C (KC5), could result in the sounding of pitches C5, C6 and C7. If either key KC4 or KC5 is depressed alone, pitch C5 is sounded by one pipe and pitch C6 is sounded by one pipe. If keys KC4 and KC5 are depressed together, pitches C5 and C6 each are sounded by two separate pipes, one associated with key KC4 and another associated with key KC5. In other words, the depression of key KC4 causes the sounding of two pipes corresponding to pitches C5 and C6 and the depression of key KC5 causes the sounding of two additional pipes corresponding to pitches C5 and C6, a total of four pipes. Naturally, pitches C5 and C6 are louder with four pipes sounding rather than two. As a result, if the performer depresses key KC4 with the 8-foot, 4-foot and 2-foot couplers operating, the depression of key KC5 with like couplers operating will result in a louder sound for pitches C5 and C6 than if the key were not depressed. This mode of operation is musically desirable, but requires a large number of pipes.

Due to the large number of pipes required in order to implement a straight coupling system, pipe organ builders also experimented with a "unified" system in which only a single rank of pipes of a particular footage is associated with a plurality of keys. According to the unified coupling system, depressing key KC4 with the 8-foot, 4-foot and 2-foot couplers operating also results in pitches C4, C5 and C6 sounding. However, the depression of key KC5 with the 8-foot and 4-foot couplers operating merely results in the continued sounding of the pipes representing pitches C5 and C6 which are already sounding as a result of the depression of key KC4. Thus, the depression of key KC5 results in no new or different sound and cannot be distinguished by the ear from the depression of key KC4 alone. Although the unified coupling system requires fewer pipes than the straight system, it is undesirable from the musician's point of view, because the depression of two keys sometimes sounds the same as the depression of a single key.

The straight and unified coupling systems used in pipe organs have been applied in principle to electronic musical instruments. Either the straight or unified coupling system could be used in connection with a keyboard of the type shown in FIG. 3 comprising keys 21–45 in which the pitch for an 8-foot coupler associated with a key is noted on each key. For example, key 21 corresponds to pitch C4 when played through an 8-foot coupler.

A fragment of an exemplary straight coupling system used in an electronic organ in connection with keys 21–45 is schematically illustrated in FIG. 1. Keys 21 and 33 operate switches S21 and S33, respectively. The straight coupling system also includes tone generators or keyers 50–55 which are capable of generating the pitches identified in FIG. 1. Each of the elements 50–55 can include a separate tone generator and keyer or can include a keyer provided with a tone signal from a tone generator which serves multiple keyers. The system also includes stop tab switches 57–59 corresponding to 8-foot, 4 foot and 2-foot couplers, respectively. By depressing key 21 with the 8-foot and 4-foot coupler switches 57 and 58 closed, pitches C6 and C7 sound. If key 33 is thereafter depressed, an additional pitch C8 sounds and pitch C7 sounds with increased loudness because it is being produced through the operation of generators or keyers 51 and 53. This operation is analogous to two pipes sounding at the same pitch.

A fragmentary unified coupling system used in an electronic organ in connection with keys 21–45 is schematically illustrated in FIG. 2. When key 21 is depressed, each of switches S218, S214 and S212 is closed; and when key 33 is depressed, each of switches S338, S334 and S332 is closed. The system also includes stop tab switches 57–59 corresponding to 8-foot, 4-foot and 2-foot couplers. Tone generators or keyers 50–52 and 55 are generating the pitches shown in the figure. Assuming switches 57 and 58 are closed (corresponding to an 8-foot and 4-foot coupler), the depression of key 21 will cause pitches C6 and C7 to sound. If, in addition, key 33 is depressed, an additional pitch C8 will sound, but pitch C7 will continue to sound with the same degree of loudness, even though it is selected for playing by the depression of both keys 21 and 33.

The straight system (FIG. 1) requires N times Y tone generators or keyers, and the unified system (FIG. 2) requires N plus Z keyers or tone generators, where N equals the total number of keys, Y equals the total number of stop tabs (or couplers) and Z equals the number of notes within the octaves encompassed between the highest and lowest stop tabs. For example, in the systems illustrated in FIGS. 1 and 2, assuming a 61 note keyboard, the straight system requires 183 keyers or tone generators (61 times 3), and the unified system requires 85 keyers or tone generators (61 plus 24, 24 notes being encompassed in the two octaves between the 8-foot and 2-foot stop tabs).

In summary, the straight system provides increased loudness for tones selected by more than one key, but only at the expense of a large number of tone sources or keyers.

SUMMARY OF THE INVENTION

The playing advantages of a straight coupling system can be realized in apparatus requiring far fewer keyers or tone generators by following the teachings described herein. Basically, it has been discovered that only certain combinations of the notes of a key-board can be selected by depressing more than one key, irrespective of the number of couplers employed in the instrument. By using this discovery, it has been possible to supplement a tone signal system generally of the unified type with a command means which enables various tone signals to be reproduced in response to the playing of one key or in response to the simultaneous playing of a plurality of keys. Converting apparatus then changes the relative loudness of a tone or pitch produced in response to the simultaneous playing of more than one key with respect to the loudness normally produced for that tone or pitch in response to the playing of a single key. As a result of this unique apparatus, a note or pitch selected by playing a plurality of keys sounds louder than a note or pitch selected by playing a single key. Moreover, this objective is achieved by using tone signal means, such as tone generators and keyer circuits, in far fewer numbers than would be required if a straight coupler system were employed.

For example, the detailed embodiment of the present invention described later requires only 2(N plus Z) minus twelve tone generators or keyers, where N and Z have the previously defined meanings. Those skilled in the art will appreciate that the numerical advantage of the present invention over the straight coupler system increases as the total number of stop tabs increases, particularly where the number of stop tabs increases while the number of notes between the highest and lowest octaves defined by the stop tabs remains the same.

As a result, a principal object of the present invention is to provide a keyer or coupler system having the same musical and playing capabilities as a straight coupler system, while having the constructional simplicity of a unified coupler system. The present system is the musical equivalent of the straight system and requires substantially fewer keyers or tone generators than the unified system, which is musically inferior.

DESCRIPTION OF THE DRAWINGS

These and other advantages, objects and features of the present invention will hereafter appear for purposes of illustration, but not of limitation, in connection with the accompanying drawings, wherein like numbers refer to like parts throughout and wherein:

FIG. 4 is an electrical schematic diagram of a preferred form of a keyer circuit used in connection with the preferred embodiment;

FIG. 4*a* is a fragmentary electrical schematic diagram of an alternative form of the keyer circuit shown in FIG. 4 which enables a tone signal transmitted by the alternative form to be selectively changed in amplitude;

FIG. 6 is a timing diagram illustrating the operation of the preferred embodiment, in which the illustrated signals appear on conductors corresponding to the like-numbered lines of the vertical axis.

DESCRIPTION OF THE PREFERRED EMBODIMENT

Figure 2:
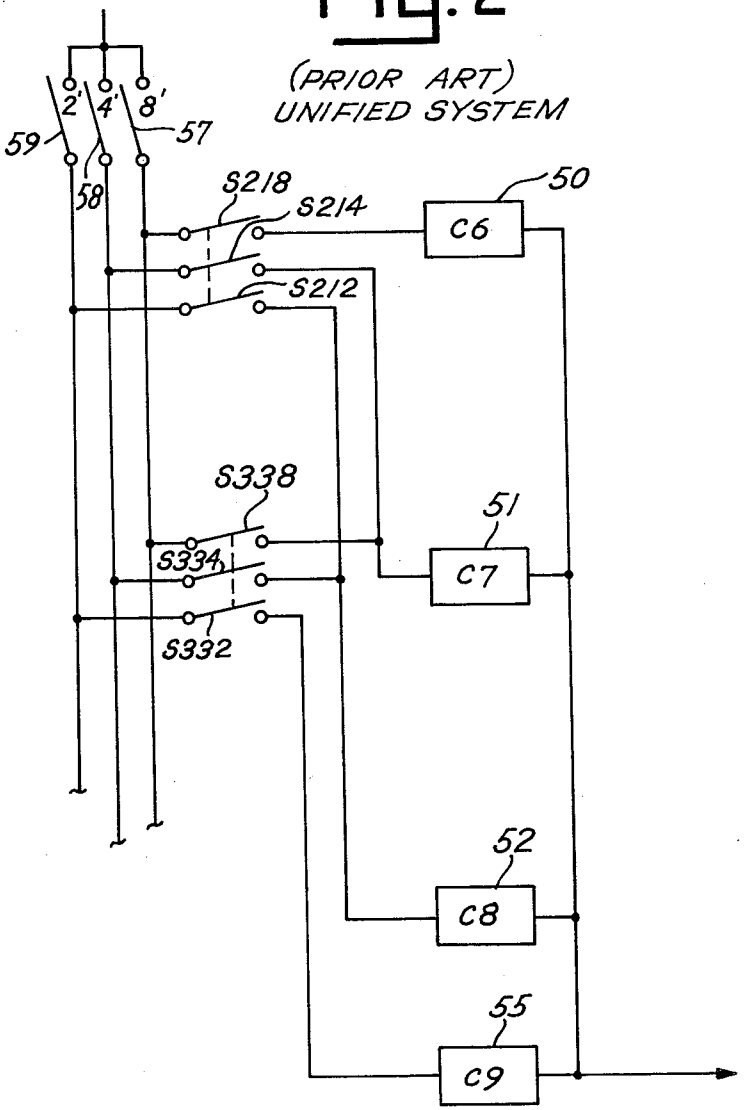
Fig. 2 (PRIOR ART)
FIG. 2 is a fragmentary electrical schematic diagram of a prior art unified coupling system.
Figure 1:
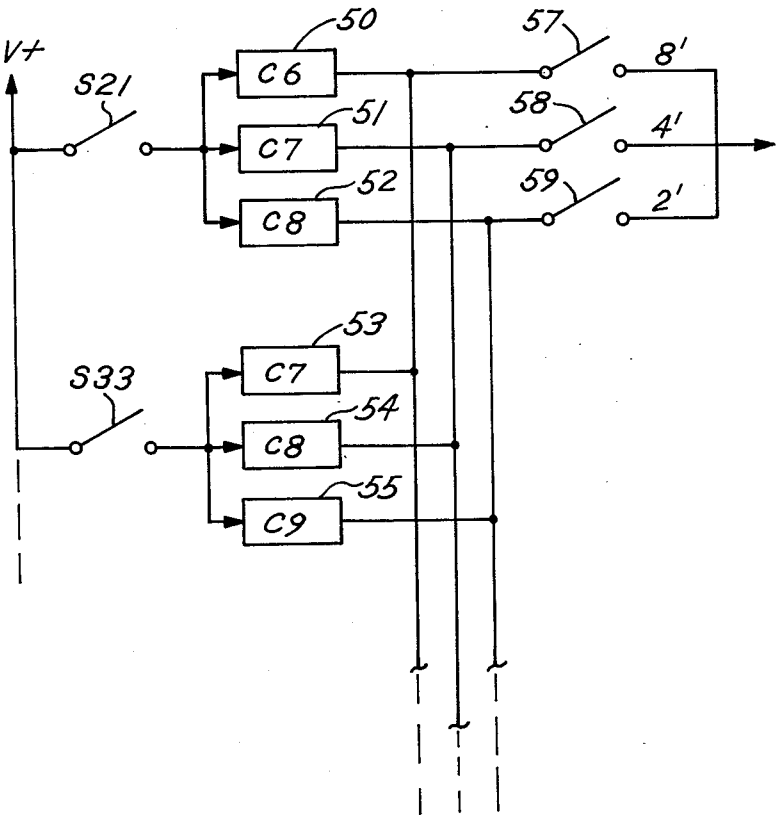
Fig. 1 (PRIOR ART)
FIG. 1 is a fragmentary electrical schematic diagram of a prior art straight coupling system.
Figure 3:
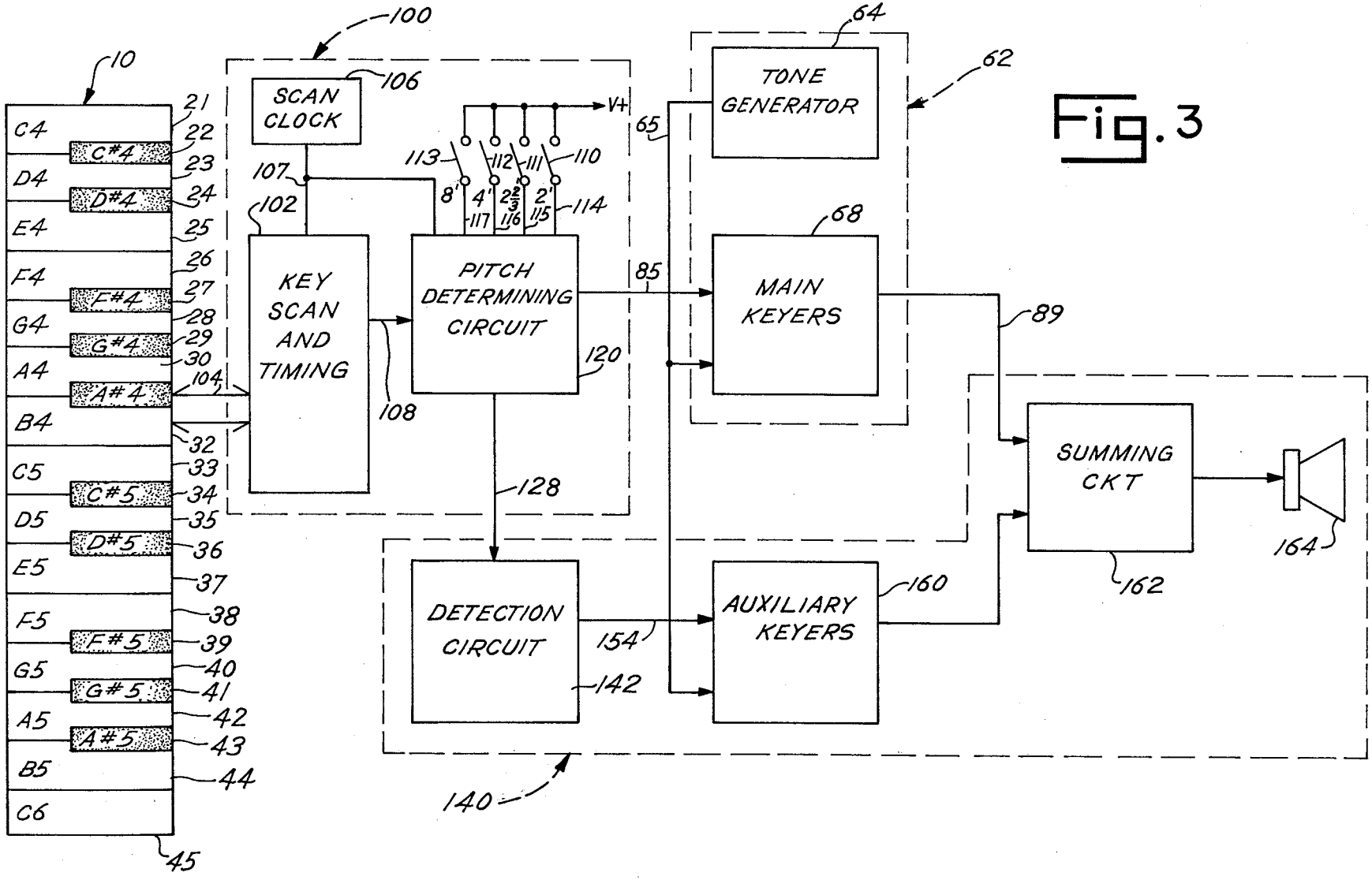
FIG. 3 is a functional block diagram of a preferred form of apparatus made in accordance with the present invention.

Referring to FIG. 3, a preferred form of the present invention basically comprises a keyboard 10, a tone signal module 62, a command module 100 and a converting module 140.

Keyboard 10 comprises keys 21–45 arranged in the form of a conventional piano or electronic organ keyboard. The pitch produced when the keys are played through an 8-foot coupler is identified on the keys in FIG. 3. For example, when played through an 8-foot coupler stop tab, the depression of key 21 results in the pitch C4 (256 Hz.), the depression of key 33 results in the pitch C5 (512 Hz.) and the depression of key 45 results in pitch C6 (1,024 Hz.) As will be described in more detail later, the depression of any one of the keys also can represent other pitches depending on the stop tabs which are in operation.

Tone signal module 62 comprises a tone signal generator 64 which transmits a group of tone signals representing different notes or pitches over a multiconductor bus 65 to a main keyer module 68 comprising a group of individual keyer circuits.

Tone signal generator 64 preferably comprises a top octave synthesizer which generates rectangular pulses at repetition rates corresponding to the pitches of the 12 semi-tones within the highest pitched octave to be played by the instrument. The twelve tone signals produced for the highest octave are divided by a series of digital divider circuits to produce the tone signals for all the lower octaves. Such a top octave synthesizer and divider technique is well known in the art and need not be described in detail.

Output bus 65 includes a separate conductor for each of the tone signals which must be produced in response to the playing of any of the keys on keyboard 10. Each of the tone signals corresponds to a different pitch or note. The conductors are each connected to a different individual keyer circuit within main keyer module 68.

Each individual keyer circuit within main keyer module 68 corresponds to a different tone signal and note to be produced by the instrument. In other words, only one keyer circuit is needed per note. This technique reduces the number of keyer circuits to a minimum and reduces the cost and complexity of the resulting instrument.

Referring to FIG. 4, a preferred form of one of the keyer circuits within main keyer module 68 comprises a transistor 70, diodes 72–74, a capacitor 76 and resistors 78–83, all connected as shown. The circuit also includes a keyer input 85*c* for receiving a keyer signal and a tone input 65*a* for receiving a tone signal from tone generator 64. In response to a keyer signal, the keyer circuit transmits a tone signal from input 65*a* to an output 89*a* with an envelope characteristic determined by the values of the components. Each of the keyer circuits has a separate output, and the combined outputs together form a bus 89 for transmitting tone signals. Likewise, the inputs, such as 85*c*, collectively form an input bus 85 for receiving keyer signals.

Referring to FIG. 3, command module 100 comprises a key scan and timing circuit 102 which communicates with keyboard 10 through a bus 104. Circuit 102 cooperates with a scan clock 106 which generates clock pulses over a conductor 107 of the type illustrated opposite the number 107 in FIG. 6 at a rate of 65 K.Hz. The clock pulses define time slots which determine the notes to be sounded in response to the depression of each of the keys. In each cycle of operation, the first 25 time slots represent the 25 keys of keyboard 10. Additional time slots also are generated during each cycle in order to represent the various notes which can be sounded in response to each key. In the present embodiment, each scan cycle includes approximately 61 time slots defined by 61 cycles of clock 106.

Circuit 102 scans keyboard 10 once during each scan cycle and generates on conductor 108 serial data representing each of the keys depressed during that scan. The data takes the form of a pulse which is generated during a time slot representing a particular key which is depressed. Scanning takes place beginning with the key representing the highest pitch and continuing through the key representing the lowest pitch. In the case of keyboard 10, the scanning starts with key 45 and concludes with key 21. That is, keys 45–21 are represented by time slots T1–T25, respectively. For example, as shown opposite the number 108 in FIG. 6, a depression of keys 45, 33, and 21 results in production of pulses in time slots T1, T13 and T25, respectively.

Circuits such as key scan and timing circuit 102 are well known in the art and are described in U.S. Pat. Nos. 3,902,397 and 3,929,051, which are incorporated by reference.

Command module 100 also comprises stop tab coupler switches 110–113 which correspond to 2-foot, 2-⅔-foot, 4-foot and 8-foot couplers, respectively. The closure of any one of switches 110–113 generates a logical one coupler signal on associated conductors 114–117, respectively. The coupler signals define the notes or pitches to be sounded in response to the playing of each of the keys on keyboard 10.

Figure 5:
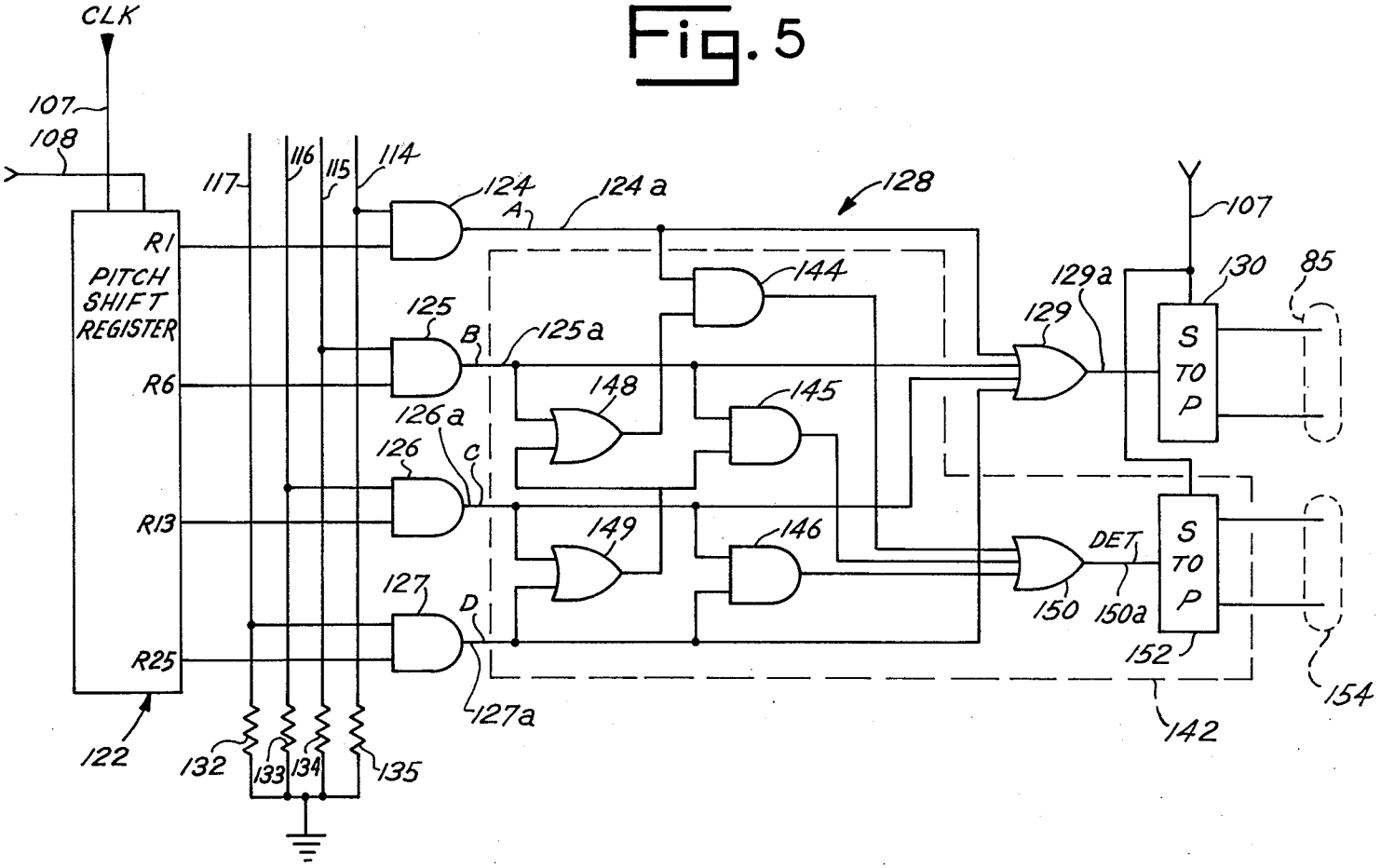
FIG. 5 is a logical block diagram of a preferred form of pitch determining circuit and detection circuit made in accordance with the preferred embodiment.

Command module 100 also includes a pitch determining circuit 120 which is shown in more detail in FIG. 5. The circuit includes a pitch shift register 122 having at least 25 output taps, each of the output taps representing a delay of one time slot defined by the clock pulses on conductor 107. Only output taps R1, R6, R13 and R25 are shown in FIG. 5 in order to illustrate the preferred embodiment. These output taps represent delays of 0, 5, 12 and 24 time slots, respectively. The output taps of the shift register generate pitch representative signals which represent the various pitches or notes which can be produced by the instrument.

Circuit 120 also includes AND gates 124–127 which are biased by resistors 132–135. The gates generate coded signals which determine each of the notes to be sounded in response to the depression of each of the keys on keyboard 10. AND gates 124–127 logically interrelate the pitch representative signals produced by shift register 122 with the coupler signals produced by tab switches 110–113. Of course, those skilled in the art will recognize that other gates associated with each of the other pitches playable by the instrument may be connected in the appropriate manner to the output taps of shift register 122. However, based on the example of gates 124–127, the other gates can easily be connected in an appropriate manner.

The outputs from gates 124–127 are connected over a bus 128 (comprising conductors 124*a*–127*a*) to the inputs of an OR gate 129. The output of the OR gate, conductor 129*a*, in turn, is connected to the input of a serial-to-parallel converter 130. Converter 130 converts the serial data signals from gate 129 into parallel form on an output bus 85 which comprises one conductor for each of the pitches or notes to be sounded by the instrument. Each conductor of bus 85 is connected to a different one of the keyer circuits within main keyer module 68. Converter 130 uses the time slots defined by scan clock 106 in order to convert the keyer signals to parallel form. Briefly, each of the time slots defines a single note which can be produced by the instrument. If a pulse appears on conductor 129*a* in any particular time slot, converter 130 raises the conductor within bus 85 associated with the keyer designed to produce a pitch corresponding to that time slot to a logical one state. For example, if the depression of any key on the keyboard 10 indicates that pitch C8 is to be produced, a pulse appears on conductor 129*a* in time slot T1 (see FIG. 6). The converter then raises to a logical one state the conductor in bus 85 connected to the keyer assigned to the production of note or pitch C8.

Converting module 140 comprises a detection circuit 142 which is shown in detail in FIG. 5. In the present example, the gates of the detection circuit are limited to those appropriate for use in connection with taps R1, R6, R13 and R25 of shift register 122. However, those skilled in the art will readily be able to connect the appropriate additional gates needed for the other taps of the shift register based on this example. The Boolean algebraic function performed by the detection circuit is:

$$DET=(C\cdot D)+(B\cdot C)+(A\cdot B)+(A\cdot C)+(B\cdot D)+(A\cdot D),$$

where DET, A, B, C and D represent the logic states of the like-lettered conductors shown in FIG. 5.

The detection circuit comprises AND gates 144–146 and OR gates 148–150 connected as shown. The detection circuit also comprises a serial-to-parallel converter 152 which is analogous to converter 130. On a multiconductor output bus 154, the converter generates keyer signals suitable for operating an auxiliary keyer module 160. The auxiliary keyer module includes keyer circuits which are identical to those in main keyer module 68 (FIG. 4). Each of the keyer circuits in module 160 corresponds to a different note capable of being selected for sounding by playing more than one key. Each of the keyer circuits is controlled by a separate conductor within bus 154. A different conductor is provided within bus 154 for each note capable of being sounded by playing more than one key. Since not all of the notes playable by the instrument can be selected for sounding by depressing more than one of the keys, not all of the taps of shift register 122 need be provided with detection circuit gates, and fewer auxiliary keyer circuits are required than main keyer circuits. For example, in the present embodiment, notes or pitches C4, C#4, D4, D#4 E4, F4, F#4, G4, G#4, A4, A#4, B4, C#7, D7, D#7, E7, F7, F#7, G7, G#7, A7, A#7, B7 and C8 cannot be selected for playing by depressing more than one key. This is an important feature of the invention which enables the instrument to provide all of the musical advantages of a straight coupling system, without using the large number of keyers normally required for a straight system.

If a note or pitch is selected for playing by the depression of more than one of the keys, the corresponding tone signal from tone generator 64 is transmitted through one of the main keyer circuits and through one of the auxiliary keyer circuits to a summing circuit 162 (FIG. 3). In the summing circuit, the tone signals from the main keyer and auxiliary keyer are algebraically added, so that the resulting amplitude is twice the amplitude of a tone signal selected for playing by depressing only one key of keyboard 10.

The output of summing circuit 162 is transmitted to a conventional output circuit 164. Circuit 164 includes a shaping circuit capable of changing the harmonic spectrum of the tone signals in order to produce a desired timbre of sound and also includes an audio amplifier which drives a loudspeaker transducer for creating audible tones or notes in response to the shaped tone signals.

The operation of the circuitry will be described with reference to FIGS. 3, 5 and 6. Assuming the player depresses keys 45, 33 and 21 while tab switches 110, 112 and 113 are closed, key scan and timing circuit 102 produces on conductor 108 pulses in time slots T1, T13 and T25 as shown in FIG. 6. Shift register 122 then produces on output taps R1, R13 and R25 the pulses shown in FIG. 6. Because the 2-foot, 4-foot and 8-foot stop tab switches are closed, three pulses are produced in response to the depression of each of the three keys on keyboard 10. These three pulses are graphically illustrated by the dotted lines labeled 45, 33 and 21 to designate the corresponding keys. Because of the operation of the stop tab switches, pitch C7 is designated for playing by the depression of keys 33 and 45; pitch C6 is designated for playing by the depression of keys 21, 33 and 45; and pitch C5 is designated for playing by the depression of keys 21 and 33. Because of the delay introduced by shift register 122, pitches C7, C6 and C5 are represented by a plurality of pulses which appear simultaneously at the different taps of shift register 122 shown in FIG. 6 in response to the simultaneous depression of different keys. Only a single one of the main keyer circuits is needed to transmit a tone signal corresponding to each of pitches C7, C6 and C5 (i.e., only a total of three main keyer circuits transmits the three tone signals).

Detection circuit 142 produces detection signals S1, S2 and S3 on conductor 150*a* corresponding to pitches C7, C6 and C5. More specifically, referring to FIGS. 5 and 6, signal S1 is generated by OR gate 150 in response to a logical one pulse from AND gate 144. AND gate 144, in turn, is switched to its logical one state by the pulse on tap R1 during time slot T13 which is transmitted through AND gate 124, and the pulse on tap R13 during time slot T13 which is transmitted through AND gate 126 and OR gates 149, 148. Signal S2 is generated by OR gate 150 in response to logical one pulses from AND gates 144 and 146. AND gate 144 is switched to its logical one state in the manner previously described. AND gate 146 is switched to its logical one state by the pulses on taps R13 and R25 during time slot T25 which are transmitted through AND gates 126, 127. Signal S3 is generated by OR gate 150 in response to a logical one pulse from AND gate 146 which is generated in the above-described manner during time slot T37.

Detection signals S1–S3 are converted to parallel form by converter 152 and are transmitted to corresponding auxiliary keyer circuits. The tone signals from a main keyer circuit and an auxiliary keyer circuit are summed to produce the combined tone signals corresponding to notes C7, C6 and C5. As a result, each of these notes or pitches sounds louder than it would normally sound if it were selected by depressing only one key of keyboard 10.

FIG. 4*a* illustrates an alternative embodiment of the keyer circuit shown in FIG. 4 which can be used to change the amplitude of a tone signal selected for playing by more than one key. As shown in FIG. 4*a*, the keyer circuit is modified by the addition of resistors 166 and 167, connected as shown. In addition, input 85*c* is changed to the free end of resistor 167, and an appropriate output from serial-to-parallel converter 152 (such as output 152*c*) is connected to the free end of resistor 166. Resistors 166 and 167 have values such that the relative amplitude of the tone signal transmitted to output 89*a* increases when keyer signals are received through both resistors 166 and 167, rather than through resistor 167 above. By using such a keyer circuit in main keyer module 68, the need for auxiliary keyer module 160 is obviated.

Those skilled in the art will recognize that the preferred embodiment described herein may be altered and modified without departing from the true spirit and scope of the invention as defined in the accompanying claims. A mechanical switch system could be used for scanning and timing in place of the digital serial data system described herein. In addition, other means could be used in order to increase the amplitude of each tone signal designated for playing by depressing more than one of the keys. For example, this function could be accomplished by providing output amplifiers which would change their gain in accordance with the number of keys which select each note.

Although those skilled in the art will be able to practice the invention based on the foregoing description, additional information about details of the described circuitry can be obtained by reference to the Model H25-4/C500 Service Manual, published by Norlin Music, Inc. under Document No. 993-028063. This document is incorporated by reference.

What is claimed is:

1. In an electronic musical instrument, improved apparatus for generating a plurality of musical notes, each note being generated at either a first level of sound intensity or a second level of sound intensity, comprising:

playable keys, each key manually actuable for commanding generation of a number of musical notes;

coupler means manually actuable for controlling the number of notes to be generated by the actuation of a key;

tone signal generation means for generating a plurality of tone signals, each said tone signal corresponding to a musical note;

command means responsive to manual actuation of said keys for generating a number of commands for each key actuated, each said command corresponding to a different note, said command means enabling said tone signal generation means to provide a tone signal for each different note associated with generated commands, said command means being responsive to said coupler means for controlling the number of commands generated for each key; and converting means for converting tone signals to audible notes, each note being generated at either a first level of sound intensity or a second level of sound intensity, said converting means for detecting substantially simultaneous generation of two commands corresponding to the same note for generating the same note at said second level of sound intensity, said converting means for detecting substantially simultaneous generation of three commands corresponding to the same note for generating the same note at said second level of sound intensity, said converting means for generating a note at said first level of sound intensity in response to a sole command from said command means.

2. Apparatus, as claimed in claim 1, wherein the converting means comprises:

means responsive to the simultaneous playing of a plurality of keys, two or more of which selecting the same pitch note, for changing the relative amplitude of a tone signal produced by said tone signal generation means with respect to the amplitude of a tone signal produced in response to the playing of a single key; and output means for converting the tone signals to sound waves.

3. Apparatus, as claimed in claim 2, wherein said output means comprises means for changing the harmonic spectrum of the tone signals and for amplifying the tone signals.

4. Apparatus, as claimed in claim 2, wherein the tone signal generation means comprises:

tone generator means for generating said tone signals; and a plurality of keyer means, each keyer means corresponding to a different one of the tone signals and for enabling one of the tone signals to be transmitted from the tone generator means to the output means in response to a keyer signal.

5. Apparatus, as claimed in claim 4, wherein said command means comprises:

scan means for generating key data signals representing the playing state of each of said keys;

tab switch means responsive to manual actuation of the coupler means for generating coupler signals indicative of the notes to be sounded in response to the playing of the keys; and note determining means responsive to the key data signals and the coupler signals for generating the keyer signals identifying each of the keyer means which needs to be enable in response to the playing of each of said keys.

6. Apparatus, as claimed in claim 5, wherein said scan means comprises means for generating serial data signals representing the playing state of each of said keys and wherein the note determining means comprises:

shift register means for delaying the serial data signals in order to form note representative signals;

first gating means for generating a coded signal each time a note representative signal represents a note selected for sounding by a coupler signal; and serial-to-parallel converter means for converting the coded signals to parallel form.

7. Apparatus, as claimed in claim 5 wherein the means for changing the relative amplitude comprises:

detection means connected to said pitch determining means and responsive to said keyer signals for generating a detection signal identifying a tone signal corresponding to a pitch selected for playing by each of two or more keys when a plurality of keys are simultaneously played;

second tone signal means for providing second tone signals, each said second tone signals corresponding to a different note, said second tone signal means responsive to a said detection signal for providing a second tone signal identified by said detection signal; and combining means for combining each said first-named tone signal and said second tone signal corresponding to the same note which is selected for playing by each of two or more keys when a plurality of keys are played to form a combined tone signal and for transmitting the combined tone signal to the output means.

8. Apparatus according to claim 7, wherein said scan means comprises means for generating serial data signals representing the playing state of each of said keys and wherein the note determining means comprises:

shift register means for delaying the serial data signals in order to form note representative signals;

first gating means for generating a coded signal each time a pitch representative signal represents a pitch selected for sounding by a coupler signal; and serial-to-parallel converter means for separating and converting the coded signals to parallel form.

9. Apparatus according to claim 8, wherein said detection means comprises second gating means connected to the first gating means for generating a detection signal.

10. Apparatus, as claimed in claim 2, wherein the means for changing the relative amplitude comprises:

detection means responsive to said command means for generating a detection signal identifying a tone signal corresponding to a note selected for playing by each of two or more keys when a plurality of keys are simultaneously played;

second tone signal means for providing second tone signals, each said second tone signals corresponding to a note, said second tone signal means responsive to a said detection signal for providing a second tone signal identified by said detection signal; and combining means for combining said first-named tone signal and said second tone signal corresponding to the same note which is selected for playing by each of two or more keys when a plurality of keys are played, to form a combined tone signal to the output means.

11. Apparatus, as claimed in claim 10, wherein said combining means comprises means for algebraically summing a said first-named tone signal and a second tone signal.

12. In an electronic musical instrument, improved apparatus for generating a plurality of musical notes, each note being generated at either a first level of sound intensity or a second level of sound intensity, comprising:

playable keys, each key manually actuable for commanding generation of a number of musical notes;

tone generator means for generating a plurality of tone signals at a first amplitude level, each tone signal corresponding to a musical note;

output means for converting a tone signal to audible sound of the note determined by the tone signal, said output means responsive to a tone signal at a first amplitude level for sounding its corresponding note at a first level of sound intensity, said output means responsive to a tone signal at a second amplitude level for sounding its corresponding note at a second level of sound intensity;

command means responsive to manual actuation of the keys for generating keyer signals required to generate each note selected for playing by the actuation of any one of the keys;

main keyer means for transmitting said tone signals having said first amplitude level to the output means, each one of said tone signals being transmitted to said output means in response to a keyer signal uniquely indentifying said one of said tone signals;

detection means responsive to said command means for generating a detection signal which identifies a given tone signal corresponding to a given note selected for playing by each of two of the keys when two or more keys are simultaneously actuated, said detection means also generating said detection signal which identifies said given tone signal when said given note is selected for playing by each of three keys when three or more keys are simultaneously actuated, said detection signal uniquely identifying said given tone signal; and means coupled to said output means and responsive to said detection signal for changing the amplitude of the tone signal identified by the detection signal to a said second amplitude level, whereby a note simultaneously selected for playing by each of two or by three of the keys when a plurality of keys are simultaneously actuated, sounds louder than the same note selected for playing by actuation of a single key.

13. Apparatus, as claimed in claim 12, wherein said command means comprises manually controllable stop tab means for defining each note selected for playing by the actuation of at least one of said keys.

14. Apparatus, as claimed in claim 12, wherein the means responsive to detection signals comprises:

auxiliary keyer means for transmitting tone signals of said first amplitude to the output means, each tone signal being transmitted in response to a detection signal uniquely identifying said tone signal; and summing means for adding the value of the tone signal, corresponding to a note, transmitted by the auxiliary keyer means to the value of the tone signal, corresponding to said note, transmitted by the main keyer means.

15. Apparatus, as claimed in claim 12, wherein the main keyer means comprises a keyer circuit for each of said tone signals and wherein the auxiliary keyer means comprises a keyer circuit for each of a group of said tone signals, each keyer circuit within the auxiliary keyer means transmitting a different one of the tone signals within said group.

* * * * *